US006672839B2

(12) United States Patent
Schloetzer

(10) Patent No.: US 6,672,839 B2
(45) Date of Patent: Jan. 6, 2004

(54) FAN WHEEL

(75) Inventor: Eugen Schloetzer, Am Steinbruch (DE)

(73) Assignee: HP Intellectual Corp., Wilmington, DE (US)

( * ) Notice: Subject to any disclaimer, the term of this patent is extended or adjusted under 35 U.S.C. 154(b) by 0 days.

(21) Appl. No.: 09/991,218

(22) Filed: Nov. 16, 2001

(65) Prior Publication Data

US 2003/0095869 A1 May 22, 2003

(51) Int. Cl.[7] ..... F04D 29/38
(52) U.S. Cl. ..... 416/238; 416/242
(58) Field of Search ..... 416/234, 238, 416/242

(56) References Cited

U.S. PATENT DOCUMENTS

| | | | | | |
|---|---|---|---|---|---|
| 368,416 | A | | 8/1887 | Mosher | |
| 1,825,473 | A | | 9/1931 | Pemsl | |
| 1,825,868 | A | | 10/1931 | Hull | |
| 1,933,949 | A | | 11/1933 | Weber | |
| 1,953,417 | A | | 4/1934 | Lindberg | |
| 1,995,193 | A | | 3/1935 | Stilphen | |
| 2,023,111 | A | | 12/1935 | Alsing | |
| 2,032,610 | A | | 3/1936 | Gibbs | |
| 2,212,041 | A | | 8/1940 | Pfautsch | |
| 2,253,066 | A | * | 8/1941 | Dowell | 416/238 |
| 2,415,380 | A | | 2/1947 | Weber | |
| 2,709,035 | A | * | 5/1955 | Schmidt | 416/242 X |
| 2,794,628 | A | | 6/1957 | Fessenden | |
| 3,782,857 | A | | 1/1974 | Svilans | 416/236 |
| 5,320,493 | A | * | 6/1994 | Shih et al. | 416/238 X |
| D419,669 | S | | 1/2000 | Shinshi et al. | D23/413 |
| 6,247,897 | B1 | | 6/2001 | Patel | 416/197 R |
| 6,325,597 | B1 | * | 12/2001 | Kim et al. | 416/238 |
| 6,371,726 | B1 | * | 4/2002 | Jonsson et al. | 416/238 X |

FOREIGN PATENT DOCUMENTS

| | | | | |
|---|---|---|---|---|
| AU | 167557 | * | 1/1951 | 416/234 |
| GB | 601160 | * | 4/1948 | 416/242 |
| GB | 635239 | * | 4/1950 | 416/242 |
| JP | 41295 | * | 2/1988 | 416/242 |

* cited by examiner

*Primary Examiner*—Edward K. Look
*Assistant Examiner*—Kimya N McCoy
(74) *Attorney, Agent, or Firm*—Barry E. Deutsch

(57) ABSTRACT

An electric fan having an electric motor and a fan wheel connected to the electric motor. The fan wheel has a hub and fan blades extending from the hub. The fan blades include a proximal section at the hub, a distal section and a middle section. The proximal section has a flat surface at a trailing edge of the blade. The trailing edge at the distal section is curved with an angle of curvature of about 10°. The trailing edge at the middle section is curved with an angle of curvature of about 36°. When the fan wheel is rotated by the electric motor at a constant speed, air pushed by each of the fan blades is propelled at a substantially same velocity and direction from the blade measured across a radial length of the blade.

17 Claims, 4 Drawing Sheets

FAN WHEEL

BACKGROUND OF THE INVENTION

1. Field of the Invention

The present invention relates to fans and, more particularly, to a fan wheel.

2. Prior Art

There are many different types of fan blades known in the art. U.S. Pat. No. 2,023,111 discloses a silent fan with a complex fan blade shape. Another example can be seen in the U.S. Pat. No. 2,212,041 which discloses another type of fan blade with various surfaces having various different radii of curvature. There is a desire to provide a new type of fan wheel which is quieter than conventional fan wheels. There is also a desire to provide a new type of fan wheel which can rotate at a slower speed than conventional fan wheels, thereby requiring a smaller motor, but still providing the same air movement as a conventional fan wheel.

SUMMARY OF THE INVENTION

In accordance with one aspect of the present invention, an electric fan is provided having an electric motor and a fan wheel connected to the electric motor. The fan wheel has a hub and fan blades extending from the hub. The fan blades include a proximal section at the hub, a distal section and a middle section. The proximal section has a flat surface at a trailing edge of the blade. The trailing edge at the distal section is curved with an angle of curvature of about 10°. The trailing edge at the middle section is curved with an angle of curvature of about 36°. When the fan wheel is rotated by the electric motor at a constant speed, air pushed by each of the fan blades is propelled at a substantially same velocity and direction from the blade measured across a radial length of the blade.

In accordance with another aspect of the present invention, a fan wheel is provided comprising a center hub section; and blades extending from the center hub section. Each blade has a leading edge and a trailing edge. A section of the blade extending from the center hub section at the trailing edge has a forward facing substantially flat surface.

In accordance with another aspect of the present invention, a fan wheel is provided comprising a center section; and blades extending from the center section. Each blade comprises a first section proximate the tip, a second section, a leading edge along the first and second sections, a trailing edge along the first and second sections, and a tip at a junction of the leading and trailing edges. The first section is curved at the trailing edge with a first angle relative to a tangent to the trailing edge of between about 7°–13°. The second section is curved at the trailing edge with a second angle relative to a tangent to the trailing edge of between about 33°–39°.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
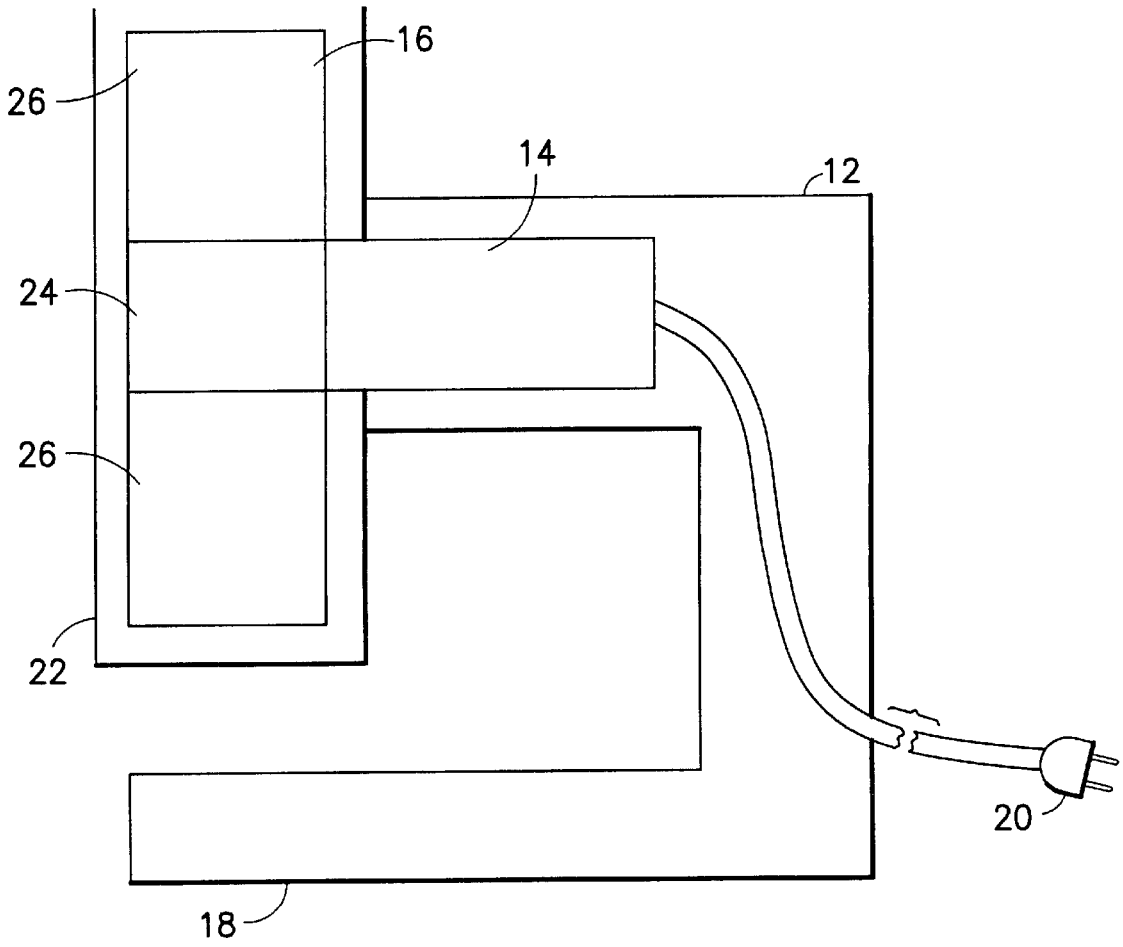
FIG. 1 is a schematic view of an electric fan incorporating features of the present invention.

Referring to FIG. 1, there is shown a schematic view of an electric fan 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

In the embodiment shown, the fan 10 generally comprises a frame 12, an electric motor 14, and a fan wheel 16. In an alternate embodiment the fan could comprise additional or alternative components. The frame 12 comprises a support 18 for stablely supporting the fan 10 on a surface. In an alternate embodiment, the frame 12 could comprise any suitable means for locating or attaching the fan relative to the ground or another member. The frame 12 could also comprise any suitable type of shape or size. Although features of the present invention are being described with reference to a stand alone fan, features of the present invention could be incorporated into any suitable type of device which includes a fan wheel.

The electric motor 14 is connected to the frame 12. In this embodiment, the electric motor 14 can be connected to a supply of electricity by a removable plug 20. However, in an alternate embodiment, the fan 10 could comprise batteries and the motor could be a battery driven motor. Alternatively, the motor 14 could be connected to any suitable type of supply of electricity. In an alternate embodiment, the motor 14 could comprise any suitable type of drive.

The fan wheel 16 is fixedly connected to the motor 14. The motor 14 is adapted to axially rotate the fan wheel 16. In this embodiment, the frame 12 includes a fan wheel cage 22. The fan wheel 16 is adapted to rotate inside the fan cage 22. The fan wheel 16 has a diameter of about 16 inches. However, the fan wheel could have any suitable diameter, such as 8 inches or 20 inches, for example.

Figure 1A:
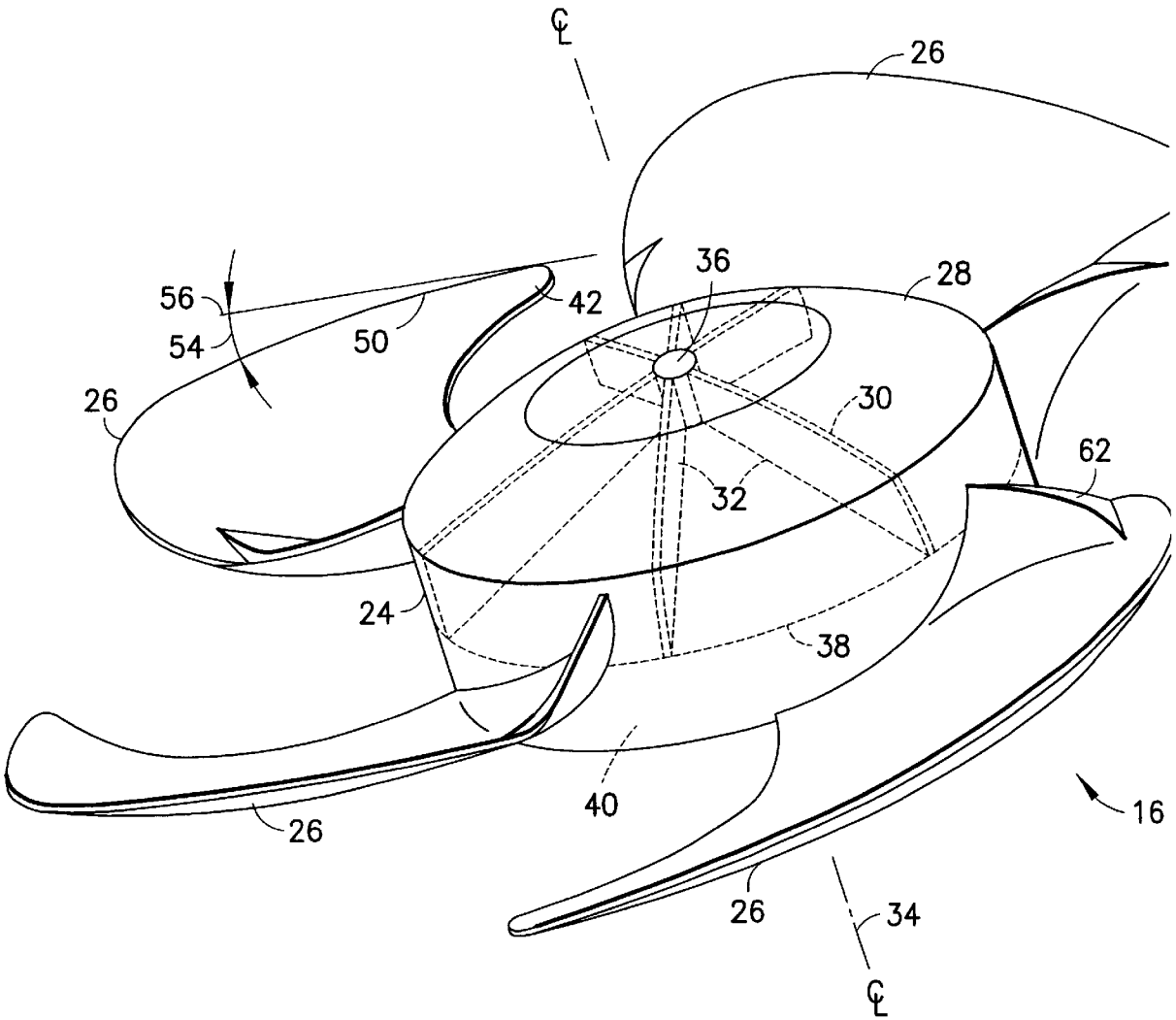
FIG. 1A is a perspective view of the fan wheel of the fan shown in FIG. 1.
Figure 2:
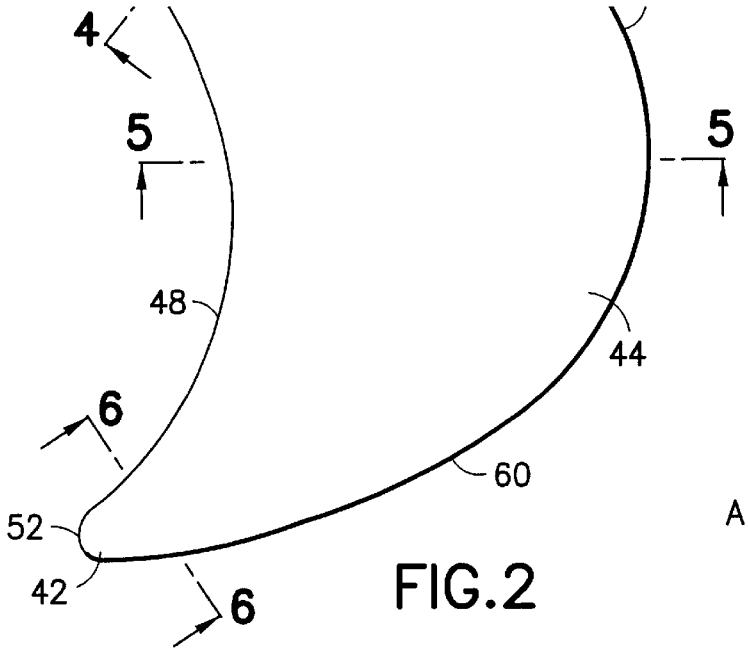
FIG. 2 is a top plan view of one of the fan blades of the fan wheel shown in FIG. 1A.

Referring also to FIG. 1A, the fan wheel 16 generally comprises a hub or center section 24 and five fan blades 26. In an alternate embodiment, the fan wheel could comprise more or less than five fan blades. In a preferred embodiment, the fan wheel 16 is a one-piece member comprised of molded plastic or polymer material. However, in alternate embodiments, the fan wheel could be comprised of multiple pieces attached as an assembly and/or could be comprised of any suitable type of material(s).

The hub 24 in the embodiment shown includes an outer section 28 and an inner support section 30. The outer section 28 is generally circular or cap shaped. However, in alternate embodiments, the outer section could have any suitable type of shape. The inner support section 30 provides structural reinforcement for the outer section 28. In the embodiment shown, the inner support section 30 generally comprises a plurality of support beams 32 extending radially outward from a center axis 34 of the hub 24. However, in alternate embodiments, the inner support section could comprise any suitable type of structural support shape. In the embodiment shown, the inner and outer sections 30, 28 form an aperture 36. The aperture 36 is aligned along the center line axis 34. The aperture 36 allows a fastener (not shown) to be passed through the aperture 36 for connecting the hub 24 to a drive shaft of the electric motor 14. However, in an alternate embodiment, the aperture 36 might not be provided. Alternatively, the hub 24 could comprise multiple apertures and/or the aperture(s) might not be aligned with the centerline axis 34. In addition, any suitable means could be used for connecting the fan wheel 16 to the electric motor 14.

In the embodiment shown, the inner support section 30 extends only partially along the height of the outer section 28. The inner support section 30 stops at a height as illustrated by the dashed line 38. This forms a relatively open area 40 inside the outer section 28 located behind the inner support section 30. The relatively open area 40 is about the same size as the outer shape of a front end of the motor 14. When the fan wheel 16 is connected to the motor 14, the front end of the motor is located inside the area 40. This provides a relatively streamlined shape between the outer surface of the motor 14 and the outer circular surface of the outer section 28. However, in an alternate embodiment, the hub 24 might not be configured for positioning a portion of the motor 14 inside the hub. As another alternate embodiment, the hub 24 could be configured to receive substantially the entire motor 14 therein.

Referring also to FIGS. 2–6, one of the blades 26 is shown. In this embodiment, the blades 26 are substantially identical to each other. However, in alternate embodiments, the fan wheel could comprise different types of fan blades. The fan blades 26 are connected to and extend from the outer perimeter of the outer section 28. Each blade 26 generally comprises a first section 42, a second section 44, a third section 46, a leading edge 48, and a trailing edge 50. The blade 26 comprises a distal tip 52 which connects the leading edge 48 with the trailing edge 50.

The first section 42 comprises a distal portion of the fan blade. The third section 46 comprises a proximal section of the fan blade. The second section 44 comprises a middle portion of the fan blade. In a preferred embodiment, the blade 26 has a substantially uniform thickness. However, in alternate embodiments, the thickness of the blade could very at predetermined locations.

The first section 42, located proximate the distal tip 52, is substantially flat. However, in an alternate embodiment, the first section might not be entirely flat. In this embodiment, the first section 42 is angled slightly downward relative to a plane perpendicular to the centerline axis 34 of the hub 24. The trailing edge 50 of the blade at the first section 42 is curved. Referring to FIG. 1A, in a preferred embodiment the trailing edge 50 at the first section 42 is curved at an angle 54 between about 7°–13° relative to a tangent 56 of the trailing edge. In the embodiment shown, the angle 54 is 10°.

Figure 5:
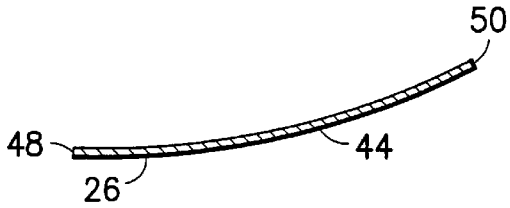
FIG. 5 is a cross sectional view of the fan blade shown in FIG. 2 taken along line 5—5.
Figure 6:
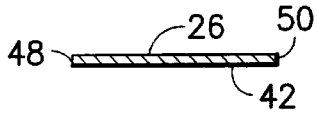
FIG. 6 is a cross sectional view of the fan blade shown in FIG. 2 taken along line 6—6.

As seen best in FIGS. 1A and 5, the second section 44, located between the first section 42 and the third section 46, has a general curved shape. More specifically, the second section 44 curves upward from the leading edge 48 to the trailing edge 50. The trailing edge 50 of the blade at the second section 44 is curved. Referring to FIG. 1A, in a preferred embodiment the trailing edge 50 at the second section 44 is curved at an angle 58 between about 33°–39° relative to a tangent 56 of the trailing edge. In the embodiment shown, the angle 58 is 36°. In the embodiment shown, the trailing edge 50 also comprises a small transition area 60 between the first and second sections.

The third section 46 is located directly adjacent the hub 24. The third section 46 also has a general curved shape. However, the third section 46 is curved at a much steeper degree of curvature than the middle section 44. In the embodiment shown, the third section 46 comprises a forward facing surface 62. The surface 62 is preferably substantially flat. However, in an alternate embodiment, the surface 62 might not be entirely flat. The surface 62 is preferably aligned in a plane perpendicular to the centerline axis 34 of the hub 24. However, in an alternate embodiment, the flat surface 62 could be slightly angled relative to the plane. In another alternate embodiment, the surface 62, as a flat forward facing surface, might not be provided.

The flat surface 62, which is substantially perpendicular to the axis of rotation 34, is generally provided to prevent inward flow of air proximate the hub 24. This helps to prevent backward flow of air at the hub and reduces air flow turbulence at the hub. The shape of the first section 42 and the angle 54 helps to reduce backward flow of air proximate the tip 52 and, thus, reduces air flow turbulence at the tip 52. The shape of the second section 42 and the angle 58 helps to reduce backward flow of air proximate the first and third sections. This helps to reduce air turbulence. In the embodiment shown, the angle 54 of 10°, the angle 58 of 36°, and the flat forward facing surface 62 have been found to provide the best reduction in backflow of air and, thus, the best reduction in air turbulence.

Figure 3:
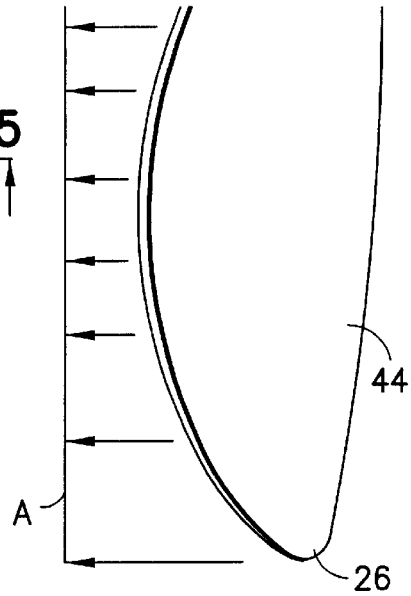
FIG. 3 is a side elevational view of the fan blade shown in FIG. 2.
Figure 4:
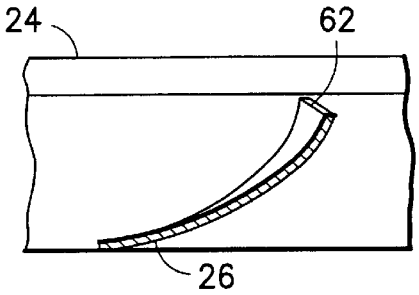
FIG. 4 is a cross sectional view of the fan blade shown in FIG. 2 taken along line 4—4.

Referring specifically to FIG. 3, the shape of the blade 26 has been designed to provide even air flow A across the length of the blade measured in a radial direction from the centerline axis 34. More specifically, the vector of the air flow (i.e., the speed and direction of the air flow) across the length of the blade, measured in a radial direction from the centerline axis 34, is substantially uniform. This helps to reduce air turbulence.

The reduction in air turbulence provides two main advantages. First, the reduction in air turbulence reduces the noise of the fan wheel as the fan wheel rotates and pushes air. Features of the present invention have been found to reduce noise about 10%–20% versus existing fan wheels. Second, the reduction in air turbulence results in a more efficient air flow handling. Because of this increased efficiency of the fan wheel 16, compared to a same size conventional fan wheel rotated at the same speed, the fan wheel 16 can move a larger quantity of air per revolution than a same size conventional fan wheel. This can provide multiple advantages.

If used with a same size motor as a conventional fan wheel, an electric fan comprising the fan wheel 16 can move a larger quantity of air per revolution of the conventional fan wheel. Because of the increased efficiency of the fan wheel 16, the fan wheel 16 can be used with a smaller size electric motor than a conventional fan wheel, but still result in the same quantity of air flow per revolution as the conventional fan wheel. In other words, the fan wheel 16 can be rotated at a slower speed than a conventional fan wheel, but still produce the same air flow as a conventional electric fan having its fan wheel rotated at a faster speed.

Use of a smaller size electric motor can obviously save costs in manufacturing. Use of a smaller size electric motor can also save electric operating costs for running the electric fan. In addition, because the fan wheel 16 can be rotated at a slower speed, this also helps to reduce air turbulence and, thereby, reduce overall noise resulting from the rotation of the fan wheel 16. The fan wheel 16, with a diameter of about 16 inches, can produce an airflow of 18 $m^3$/min. at a speed of about 900 rpm (±10%) versus a convention same size fan wheel which needs to be rotated at 1400–1500 rpm to produce the same airflow.

Figure 7:
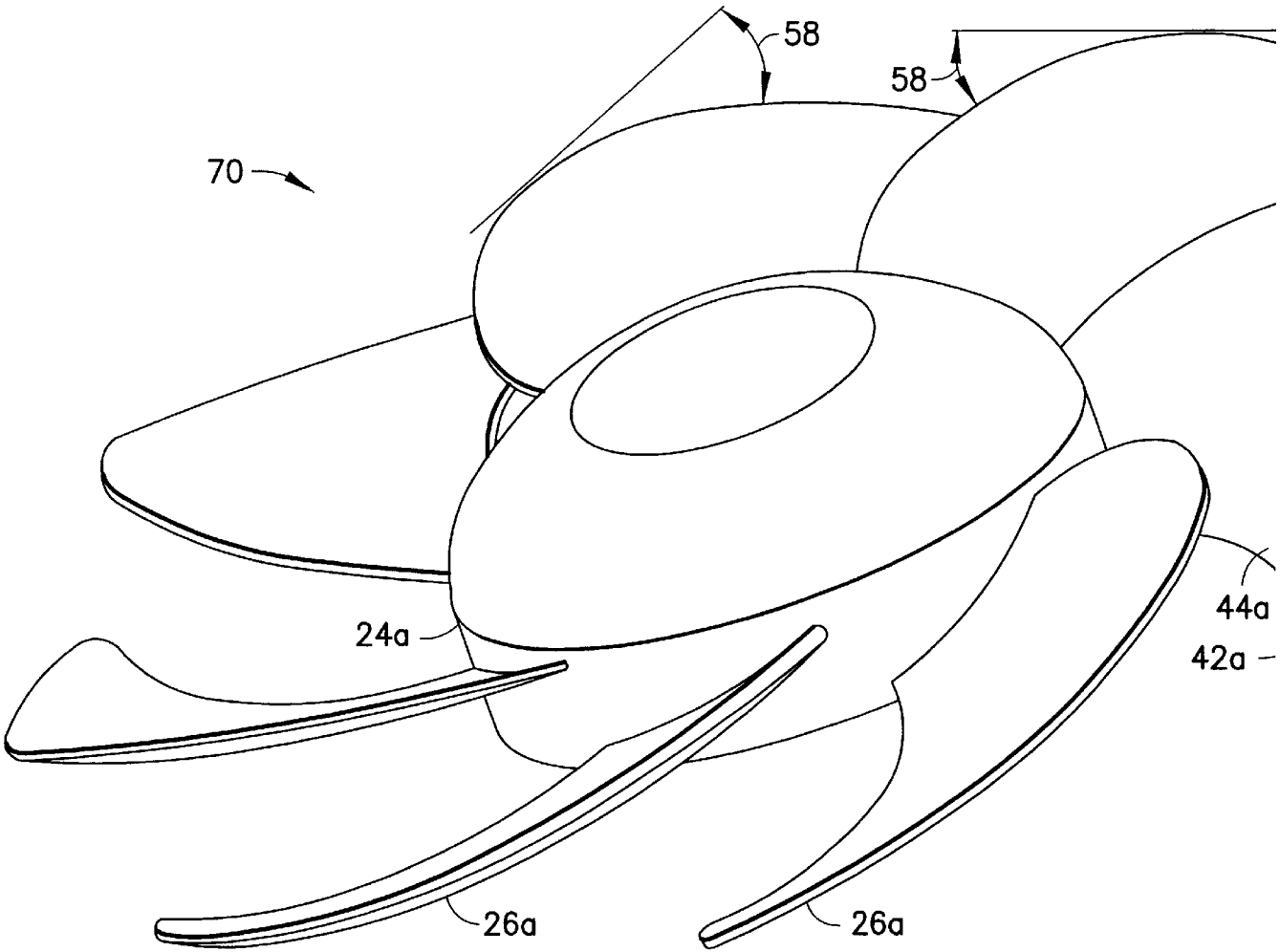
FIG. 7 is a perspective view of an alternate embodiment of a fan wheel incorporating features of the present invention.

Referring now to FIG. 7, an alternate embodiment of the fan wheel is shown. In this embodiment, the fan wheel 70 is substantially similar to the fan wheel 16 shown in FIG. 1A. However, in this embodiment, the fan wheel 70 comprises seven fan blades 26*a*. In an alternate embodiment, the fan wheel might comprise merely three fan blades. Each of the fan blades 26*a* are substantially the same as the fan blades 26. The fan blades 26*a* include a first section 42*a* having a trailing edge curved with the angle 54. The fan blades 26*a* also include second sections 44*a* having a trailing edge curved with the angle 58. However, in this embodiment, the blades do not comprise third sections 46 and the flat forward facing surface 62. Instead, the second sections 44*a* extend to the hub 24*a*. In addition, in this embodiment, the hub 24*a* does not comprise the aperture 36. The hub 24 would be connected to the electric motor by an attachment without a fastener passing through a throughhole in the hub 24*a*. This embodiment illustrates that features of the present invention could be incorporated into a fan wheel without having the flat surface 62. In addition, in alternate embodiments, features of the present invention could be incorporated into a fan wheel including the flat surface 62, but having variations on the rest of the fan blade.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A fan wheel comprising:

a center section; and blades extending from the center section, each blade comprising a first section proximate a blade tip, a second section, a leading edge along the first and second sections, a trailing edge along the first and second sections, the blade tip being formed at a junction of the leading and trailing edges, wherein the first section is curved at the trailing edge with a first angle relative to a tangent to the first section at the trailing edge of between about 7°–13°, wherein the second section is curved at the trailing edge with a second angle relative to a tangent to the second section at the trailing edge of between about 33°–39°, said second section being curved upwardly from the leading edge to the trailing edge, said second section having a substantially inverted cup-like shape.

2. A fan wheel as in claim 1 wherein the first angle is about 10°.

3. A fan wheel as in claim 1 wherein the second angle is about 36°.

4. A fan wheel as in claim 1 wherein each blade further comprises a third section located adjacent the center section, the third section having a forward facing substantially flat surface located at the trailing edge, the surface being aligned in a plane perpendicular to a center axis of the center section.

5. A fan wheel as in claim 4 wherein the first section is substantially flat.

6. A fan wheel as in claim 5 wherein the second section is curved with a substantially uniform thickness.

7. A fan wheel as in claim 6 wherein the third section is curved with a steeper curvature than the second section.

8. A fan wheel comprising:

a center hub section; and blades extending from the center hub section, each blade having a leading edge and a trailing edge, a section of the blade extending from the center hub section at the trailing edge having a forward facing substantially flat surface.

9. A fan wheel as in claim 8 wherein the surface is located along a plane perpendicular to a center axis of the center hub section.

10. A fan wheel as in claim 8 wherein each blade comprising a distal section proximate a tip of the blade and a middle section, wherein the distal section is curved at the trailing edge with a first angle relative to a tangent to the distal section at the trailing edge of between about 7°–13°, and wherein the middle section is curved at the trailing edge with a second angle relative to a tangent to the middle section at the trailing edge of between about 33°–39°.

11. A fan wheel as in claim 10 wherein the first angle is about 10°.

12. A fan wheel as in claim 10 wherein the second angle is about 36°.

13. A fan wheel as in claim 10 wherein the distal section is substantially flat.

14. A fan wheel as in claim 10 wherein the middle section is curved with a substantially uniform thickness.

15. A fan wheel as in claim 14 wherein the proximal section has a substantially uniform thickness and is curved with a steeper curvature than the middle section.

16. An electric fan comprising:

an electric motor; and a fan wheel connected to the electric motor, the fan wheel comprising a hub and fan blades extending from the hub, the fan blades comprising a proximal section at the hub, a distal section and a middle section, the proximal section having a flat surface at a trailing edge of the blade, the trailing edge at the distal section being curved with an angle of curvature of about 10°, and the trailing edge at the middle section being curved with an angle of curvature of about 36°, wherein when the fan wheel is rotated by the electric motor at a constant speed, air pushed by each of the fan blades is propelled at a substantially same velocity and direction from the blade measured across a radial length of the blade.

17. An electric fan as in claim 16 wherein the distal section is substantially flat.

* * * * *